US008622506B2

(12) United States Patent
Fujisawa

(10) Patent No.: US 8,622,506 B2
(45) Date of Patent: Jan. 7, 2014

(54) PRINTING DEVICE

(75) Inventor: Kazuhito Fujisawa, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 41 days.

(21) Appl. No.: 13/481,236

(22) Filed: May 25, 2012

(65) Prior Publication Data

US 2012/0306948 A1 Dec. 6, 2012

(30) Foreign Application Priority Data

May 30, 2011 (JP) ..... 2011-120284

(51) Int. Cl.
*B41J 29/393* (2006.01)

(52) U.S. Cl.
USPC ..... 347/19

(58) Field of Classification Search
CPC ..... B41J 2/17546
USPC ..... 347/5, 9, 14, 19, 50, 57, 58, 85
See application file for complete search history.

(56) References Cited

U.S. PATENT DOCUMENTS 4,401,999 A * 8/1983 Brown, Jr. ..... 347/142
7,364,252 B2 * 4/2008 Asauchi ..... 347/19
2007/0126770 A1 6/2007 Asauchi

FOREIGN PATENT DOCUMENTS

JP 05-299123 A 11/1993
JP 4539654 B2 7/2010

* cited by examiner

*Primary Examiner* — An Do
(74) *Attorney, Agent, or Firm* — Kilpatrick Townsend & Stockton LLP

(57) ABSTRACT

A printing device includes: a printing material container that includes first and second short circuit detection terminals, first and second attachment detection terminals; a high voltage power supply that applies a high voltage to the first attachment detection terminal; a short circuit detector that detects a short circuit between at least one of the first and second short circuit detection terminals and at least one of the first and second attachment detection terminals; a high voltage application controller that blocks supply of the high voltage from the high voltage power supply when the short circuit detector detects the short circuit; a resistor element that is arranged between the high voltage power supply and the first attachment detection terminal; and an electrostatic capacitor element that is arranged between the detection node of the short circuit detector and a low-potential-side power supply node.

6 Claims, 8 Drawing Sheets

300
INTEGRATED CIRCUIT DEVICE
340b
CARTRIDGE EJECTION DETECTOR (INPUT SIDE)
DPres
350
CONTROLLER
VSHT
310
SHORT CIRCUIT DETECTOR
VCNT
320
HIGH VOLTAGE APPLICATION CONTROLLER
RA
VHV
VHO
ND
CA
VSS
100
IC1
DT1
CO1
RD
CO2
DT2
D1
RB1
D2
IC2
RB2
330
VHO
ATTACHMENT DETECTOR
SIDET
IDET
TO CPU
D3
IC3
RB3
340a
CARTRIDGE EJECTION DETECTOR (OUTPUT SIDE)
D4
IC4
DPins
D5
RB4

$$IDET = \frac{VHO - VREF}{Rc} \qquad Rc = R\frac{1}{\sum_{j=1}^{N}\frac{1}{2^j}}$$

PRINTING DEVICE

BACKGROUND

1. Technical Field

The present invention relates to a printing device and the like.

2. Related Art

For a printing device that has a detecting circuit that detects the type of a printing material container (ink cartridge or the like) and detects whether or not the printing material container is attached to the printing device, a technique for preventing or suppressing failure, which is caused by a short circuit between the detecting circuit and another circuit included in the printing device, of the printing material container and the printing device is described in Japanese Patent No. 4539654, for example.

A short circuit protection circuit that is included in a rechargeable secondary battery pack with a function of displaying a remaining capacity is described in JP-A-5-299123, for example.

These techniques, however, have problems that it is difficult to improve the accuracy of a determining circuit for determining whether or not a short circuit has occurred and there is a risk that a current due to a short circuit flows even for a short period from the time when the short circuit has been detected to the time when a protection circuit operates and breaks another circuit.

SUMMARY

An advantage of some aspects of the invention is that it provides a printing device that is capable of reliably and safely detecting attachment of a printing material container.

According to an aspect of the invention, a printing device includes: a printing material container that includes a first short circuit detection terminal, a second short circuit detection terminal, a first attachment detection terminal and a second attachment detection terminal; a high voltage power supply that applies a high voltage to the first attachment detection terminal; a short circuit detector that detects a short circuit between at least one of the first and second short circuit detection terminals and at least one of the first and second attachment detection terminals on the basis of a comparison between a voltage of a detection node and a reference voltage; a high voltage application controller that blocks supply of the high voltage from the high voltage power supply when the short circuit detector detects a short circuit; a resistor element that is arranged between the high voltage power supply and the first attachment detection terminal; and an electrostatic capacitor element that is arranged between the detection node of the short circuit detector and a low-potential-side power supply node. When the short circuit detector detects the short circuit, a period from the time when the high voltage is applied to the first attachment detection terminal to the time when the voltage of the detection node reaches a predetermined voltage is set on the basis of a resistance of the resistor element and a capacitance of the electrostatic capacitor element.

According to the aspect of the invention, the short circuit detector can detect whether or not a short circuit has occurred between terminals in order for the printing device to detect attachment of the printing material container. When the short circuit detector detects the short circuit, the high voltage application controller can block the supply of the high voltage. Since the resistor element and the electrostatic capacitor element are arranged, the period to the time when the voltage of the detection node reaches the predetermined voltage can be set long. Thus, the high voltage application controller can block the supply of the high voltage before a high voltage that may cause another circuit such as a storage device to be broken is applied. As a result, the printing device that can reliably and safely detect the attachment of the printing material container and is highly reliable can be achieved.

The printing device according to the aspect may further include an integrated circuit device. The short circuit detector and the high voltage application controller may be arranged in the integrated circuit device, and the resistor element may be arranged between the high voltage power supply and the integrated circuit device and may be an overcurrent protective resistor element for the high voltage power supply.

According to the above, when an excessive current flows in the integrated circuit device, the resistor element can function as an overcurrent protective resistor element for the high voltage power supply. Thus, it is possible to prevent the high voltage power supply from being broken due to the excessive current or prevent failure from occurring in the high voltage power supply.

According to the aspect of the invention, the resistor element may be a short circuit detection resistor element that is used to detect a short circuit between a high voltage power supply node included in the integrated circuit device and the low-potential-side power supply node.

According to the above, when the short circuit has occurred between the high voltage power supply node and the low-potential-side power supply node in the integrated circuit device, the amount of current that flows in the resistor element rapidly increases and the high voltage drops. It is possible to detect the short circuit occurred in the integrated circuit device by detecting the voltage drop.

According to the aspect of the invention, the printing material container may include an attachment detection resistor element that is arranged between the first attachment detection terminal and the second attachment detection terminal, the integrated circuit device may include an attachment detector that detects attachment of the printing material container on the basis of a current flowing in the attachment detection resistor element and a standard voltage generated from the high voltage supplied from the high voltage power supply.

According to the above, values of a current that flows into the attachment detector correspond to attached and unattached states of the printing material container and are different from each other. The attachment detector determines the attached or unattached state by detecting the difference between the current values. The difference between the current values can be accurately detected using a standard voltage generated from the high voltage supplied from the high voltage power supply. Thus, the attachment detector can reliably detect the attachment of the printing material container.

According to the aspect of the invention, the printing device may include a plurality of printing material containers The first and second short circuit detection terminals of the printing material containers may be connected to the detection node of the single short circuit detector through a plurality of diodes.

According to the above, forward currents flow from the first and second short circuit detection terminals toward the detection node through the diodes. In the printing device that includes the plurality of printing material containers, currents that flow due to short circuits occurred between terminals of the printing material containers can be led to the detection node of the short circuit detector through the diodes.

According to the aspect of the invention, the printing material container may include a storage device, and the reference voltage may be set to a voltage value that does not cause the storage device to be broken when the short circuit detector detects the short circuit.

According to the above, when the voltage of the detection node reaches a voltage value that is lower than a voltage value that may cause the storage device to be broken, the short circuit detector detects the short circuit. As a result, it is possible to prevent another circuit such as the storage device from being broken due to the application of the high voltage.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention is described in detail. The embodiment described below does not unduly limit the contents of the invention described in Claims. Configurations described in the embodiment are not all essential as solving means of the invention.

1. Printing Device

Figure 1:
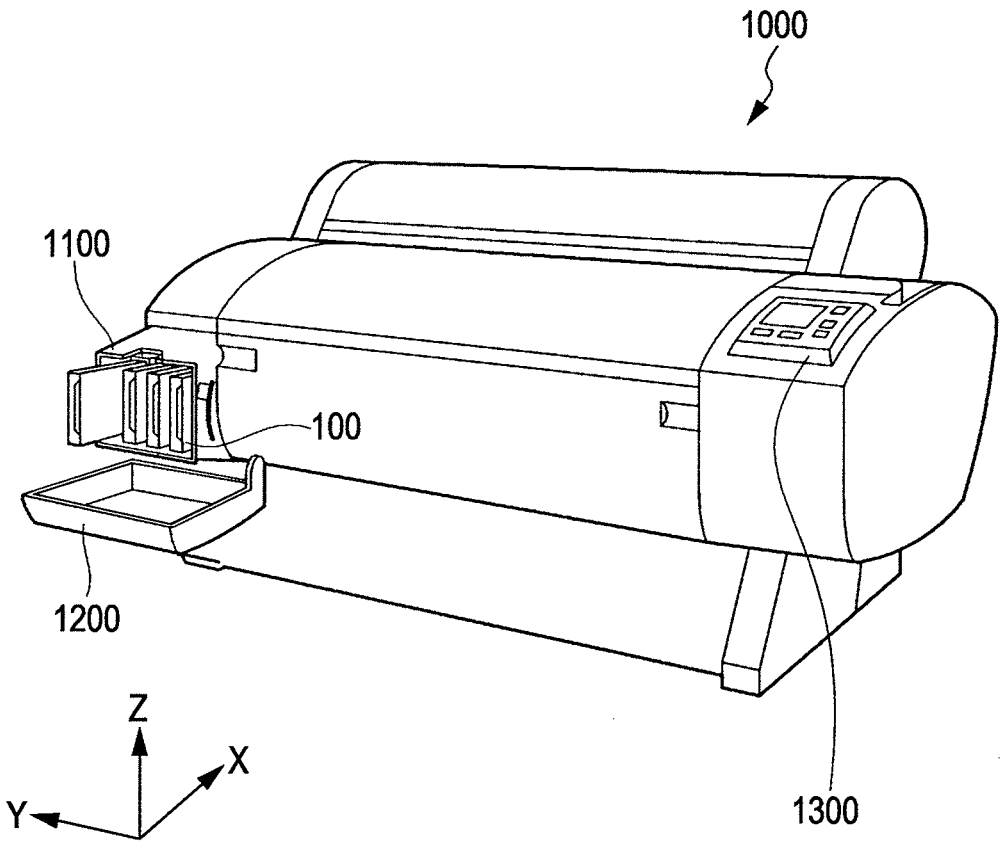
FIG. 1 is a perspective view of an example of the configuration of a printing device.

FIG. 1 is a perspective view of an example of the configuration of a printing device according to the embodiment. A printing device 1000 includes a cartridge attachment section 1100, a cover 1200 and an operating section 1300. An ink cartridge (printing material container) is attached to the cartridge attachment section 1100. The cover 1200 is capable of rotating. The cartridge attachment section 1100 is also referred to as a "cartridge holder" or a "holder". In the example illustrated in FIG. 1, four ink cartridges can be independently attached to the cartridge attachment section 1100. For example, four ink cartridges (printing material containers) 100 of black, yellow, magenta and cyan are attached to the cartridge attachment section 1100. The cover 1200 may be omitted. The operating section 1300 is an input device that is used for a user to enter various instructions and setting information. The operating section 1300 has a display unit that informs the user of various notifications.

Figure 2B:
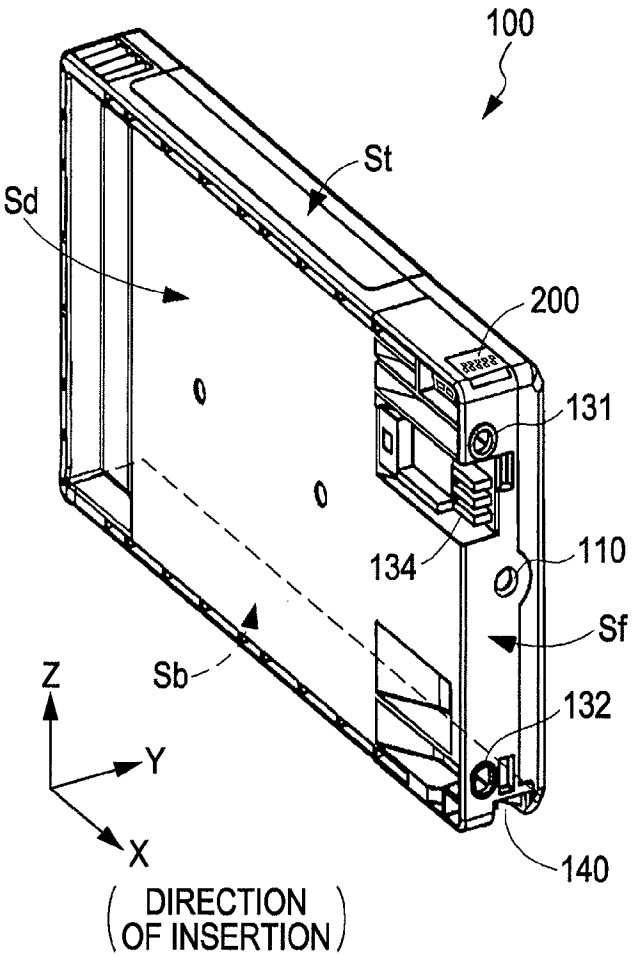
FIGS. 2A and 2B are perspective views of appearances of a printing material container.
Figure 2A:
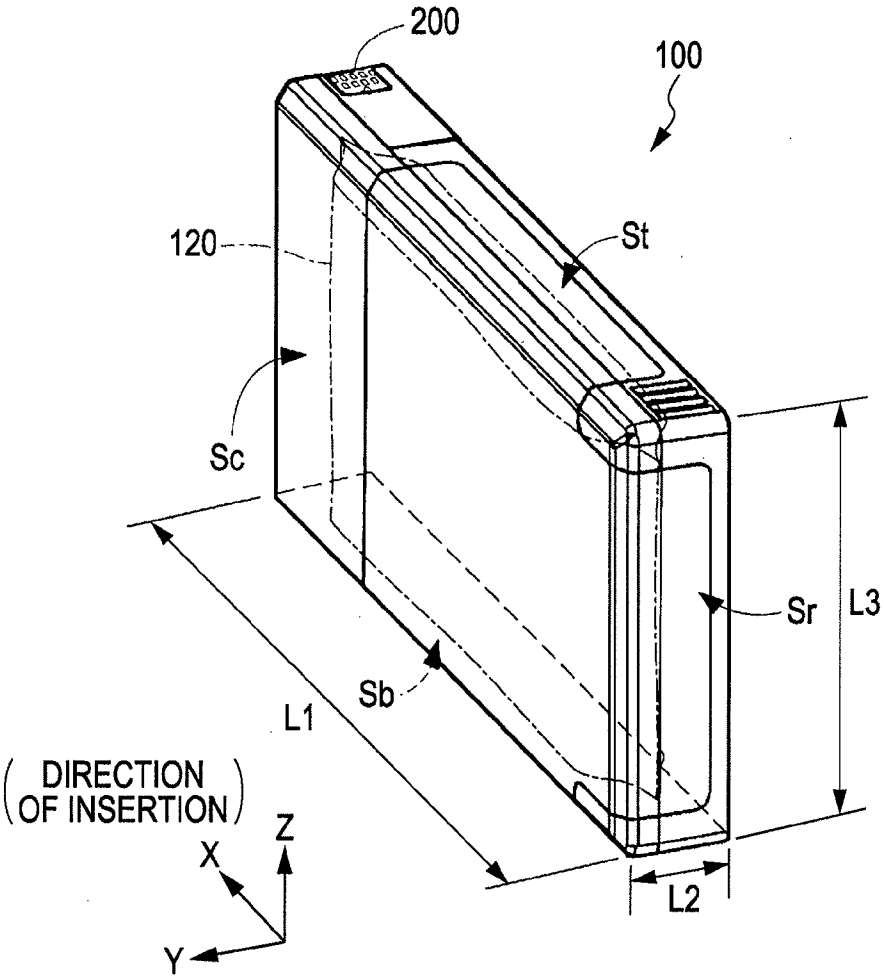

FIGS. 2A and 2B are perspective views of appearances of the printing material container (ink cartridge) 100. X, Y and Z axes illustrated in FIGS. 2A and 2B correspond to X, Y and Z axes illustrated in FIG. 1. The ink cartridge is hereinafter also referred to as a "cartridge". The cartridge 100 is formed in a flat and substantially rectangular parallelepiped shape. The cartridge 100 has a length L1, a width L2 and a height L3 in three directions. The length L1 (size in a direction in which the cartridge 100 is inserted into the printing device 1000) is largest. The width L2 is smallest. The height L3 is larger than the width L2 and smaller than the length L1.

The cartridge 100 has a front surface (first surface) Sf, a back surface (second surface) Sr, a top surface (third surface) St, a bottom surface (fourth surface) Sb and first and second side surfaces (fifth and sixth surfaces) Sc and Sd. The cartridge 100 has therein an ink storage chamber 120 (also referred to as "ink storage bag") made of a flexible material. The front surface Sf has two positioning holes 131 and 132 and an ink supply port 110. A circuit board 200 is arranged on the top surface St. A nonvolatile storage device 203 for storing information on ink is mounted on the circuit board 200. The first and second side surfaces Sc and Sd are opposite surfaces and are perpendicular to the front surface Sf, the top surface St, the back surface Sr and the bottom surface Sb. The cartridge 100 has a projections-and-depressions engagement section 134 arranged at a position where the second side surface Sd and the front surface Sf intersect each other.

Figure 3A:
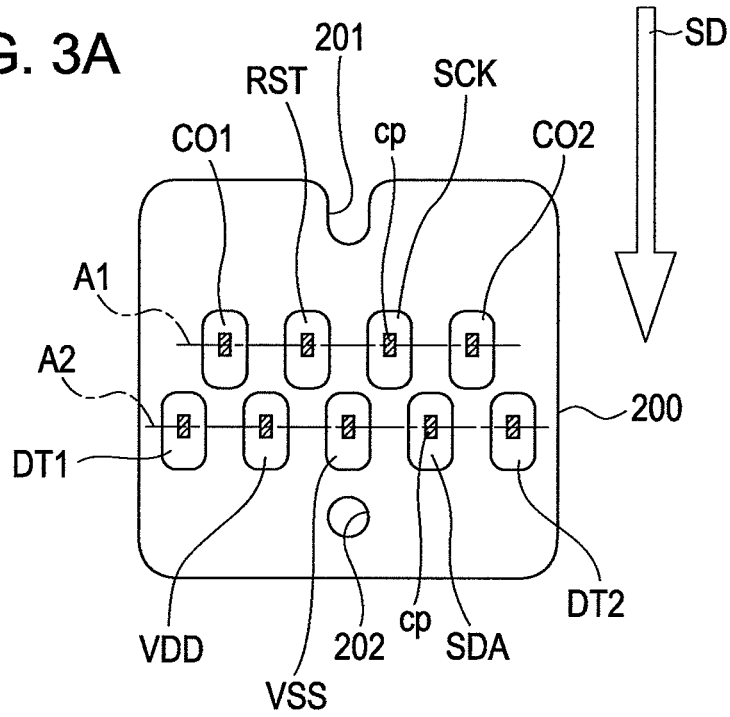
FIGS. 3A and 3B are diagrams illustrating an example of the configuration of a circuit board.
Figure 3B:
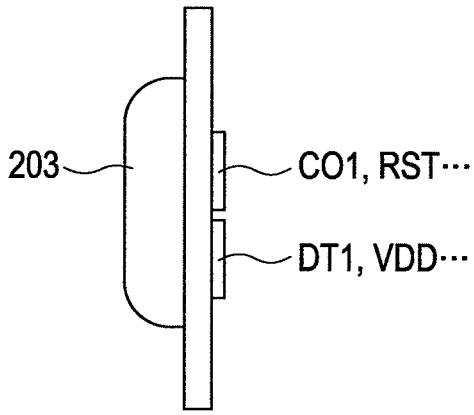

FIG. 3A illustrates an example of the configuration of the circuit board 200 according to the embodiment. A surface of the circuit board 200 is exposed to the outer side of the cartridge 100 when it is attached to the cartridge 100. FIG. 3B is a diagram illustrating the circuit board 200 when it is viewed from a side surface thereof. The circuit board 200 has a boss groove 201 at an upper end portion thereof and a boss hole 202 at a lower end portion thereof.

An arrow SD illustrated in FIG. 3A indicates a direction in which the cartridge 100 is attached to the cartridge attachment section 1100. The direction SD matches a direction (X direction) in which the cartridge 100 illustrated in FIGS. 2A and 2B is attached to the cartridge attachment section 1100. The circuit board 200 has the storage device 203 mounted on the back surface thereof. The circuit board 200 has a terminal group of nine terminals mounted on the front surface thereof. The storage device 203 stores the information (for example, a remaining amount of the ink) on the ink of the cartridge 100. The terminals are each formed in a substantially rectangular shape. The terminals are arranged in two rows that are substantially perpendicular to the direction SD.

Among the two rows, a row (located on the upper side in FIG. 3A) that is located in the rear in the direction SD is referred to as an upper row A1 or first row and the other row (located on the lower side in FIG. 3A) that is located in the front in the direction SD is referred to as a lower row A2 or second row. It can be considered that the rows A1 and A2 are rows formed by contact portions cp of the terminals.

Terminals CO1, RST, SCK and CO2 forming the upper row A1 and terminals DT1, VDD, VSS, SDA and DT2 forming the lower row A2 have the following functions (or are used for the purposes described below).

Upper Row A1

(1) First short circuit detection terminal CO1

(2) Reset terminal RST (3) Clock terminal SCK (4) Second short circuit detection terminal CO2

Lower Row A2

(5) First attachment detection terminal DT1

(6) Power supply terminal VDD (7) Ground terminal VSS (8) Data terminal SDA (9) Second attachment detection terminal DT2

The first and second attachment detection terminals DT1 and DT2 are used to detect whether or not the printing material container (ink cartridge) 100 has been properly attached to the cartridge attachment section 1100, as described later. The first and second short circuit detection terminals CO1 and CO2 are used to detect short circuits that have occurred between the first and second short circuit detection terminals CO1 and CO2 and the first and second attachment detection terminals DT1 and DT2. The remaining five terminals RST, SCK, VDD, VSS and SDA are terminals for the storage device 203 and are also referred to as "memory terminals".

The terminals have the contact portions cp at central portions thereof. The contact portions cp of the terminals are in contact with corresponding terminals in the printing device 1000. The contact portions cp of the terminals that form the upper row A1 and the contact portions cp of the terminals that form the lower row A2 are alternately arranged in a staggered manner. The terminals that form the upper row A1, and the terminals that form the lower row A2, are alternately arranged in a staggered manner so that positions of the centers of the terminals that form the upper row A1 do not correspond with positions of the centers of the terminals that form the lower row A2 in the direction SD.

The contact portions cp of the first and second short circuit detection terminals CO1 and CO2 of the upper row A1 are arranged at both ends of the upper row A1 or arranged on the outermost sides of the upper row A1. The contact portions cp of the first and second attachment detection terminals DT1 and DT2 of the lower row A2 are arranged at both ends of the lower row A2 or arranged on the outermost sides of the lower row A2. The contact portions cp of the memory terminals RST, SCK, VDD, VSS and SDA are arranged in a substantially central part of a region in which the nine terminals are arranged. The contact portions cp of the first and second short circuit detection terminals CO1 and CO2 and the contact portions cp of the first and second attachment detection terminals DT1 and DT2 are arranged at four corners of a region in which the memory terminals RST, SCK, VDD, VSS and SDA are arranged.

Figure 4:
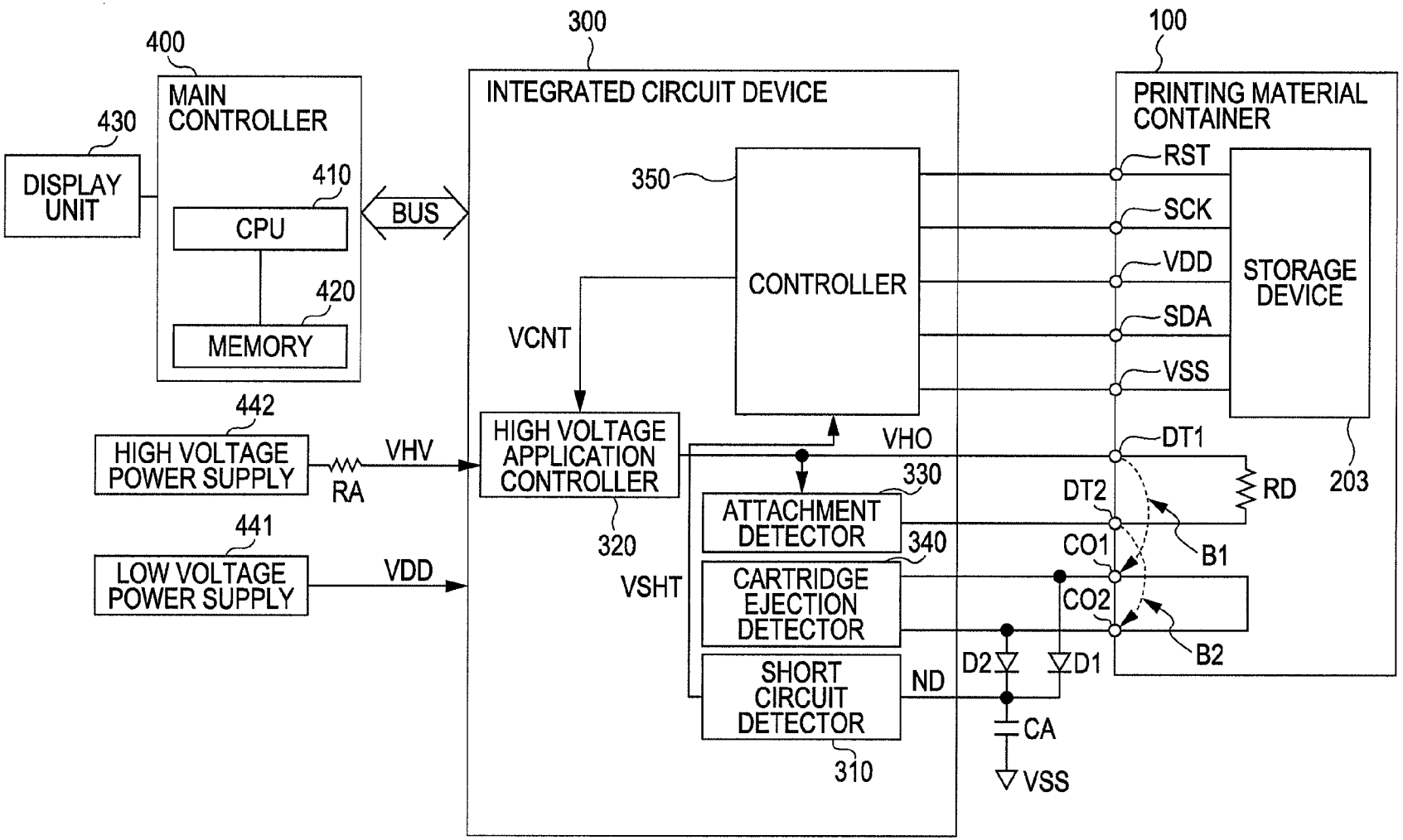
FIG. 4 is a diagram illustrating an example of a basic electrical configuration of the printing device.

FIG. 4 illustrates an example of a basic electrical configuration of the printing device 1000 according to the embodiment. The printing device 1000 according to the embodiment includes the printing material container 100, an integrated circuit device 300, a main controller 400, a low voltage power supply 441, a high voltage power supply 442, a display unit 430, a resistor element RA and an electrostatic capacitor element CA. The integrated circuit device 300 includes a short circuit detector 310, a high voltage application controller 320, an attachment detector 330, a cartridge ejection detector 340 and a controller 350. The configuration of the printing device 1000 according to the embodiment is not limited to the configuration illustrated in FIG. 4 and may be variously modified. Some of the constituent elements of the printing device 1000 may be omitted or replaced with other constituent elements. Other constituent elements may be added to the printing device 1000. For example, the cartridge ejection detector 340 may be omitted.

The main controller 400 includes a CPU 410 and a memory 420 and performs communication with the integrated circuit device 300 through a bus BUS.

The display unit 430 informs the user of various pieces of information such as an operational state of the printing device 1000 and an attached or unattached state of the cartridge. The display unit 430 is included in the operating section 1300 illustrated in FIG. 1, for example.

The low voltage power supply 441 generates a low power supply voltage (first power supply voltage) VDD. The first power supply voltage VDD is a normal power supply voltage (rated voltage of 3.3 V) to be used for a logic circuit. The high voltage power supply 442 is a power supply for applying a high voltage to the first attachment detection terminal DT1 and generates a high power supply voltage (second power supply) VHV. The second power supply voltage VHV is a high voltage (for example, a rated voltage of 42 V) to be used to drive a print head and eject ink. The voltages VDD and VHV are supplied to the integrated circuit device 300. The voltages VDD and VHV are supplied to other circuits when necessary. Specifically, the high power supply voltage VHV is supplied from the high voltage power supply 442 through the resistor element RA to the high voltage application controller 320 of the integrated circuit device 300. A high voltage VHO is output from the high voltage application controller 320 and supplied to the first attachment detection terminal DT1 of the printing material container 100 and the attachment detector 330.

Among the nine terminals mounted on the circuit board 200 (illustrated in FIGS. 3A and 3B) of the cartridge 100, the reset terminal RST, the clock terminal SCK, the power supply terminal VDD, the ground terminal VSS and the data terminal SDA are electrically connected to the storage device 203. The storage device 203 does not have an address terminal and is a nonvolatile memory, where a memory cell to be accessed is determined on the basis of the number of pulses of a clock signal input from the clock terminal SCK and command data input through the data terminal SDA. The storage device 203 is synchronized with the clock signal so as to receive data through the data terminal SDA or transmit data through the data terminal SDA. The clock terminal SCK is used to supply the clock signal from the controller 350 to the storage device 203.

A power supply voltage (of, for example, 3.3 volts) that is used to drive the storage device 203 is supplied from the printing device 1000 to the power supply terminal VDD. A ground voltage (of 0 volts) is supplied from the printing device 1000 to the ground terminal VSS. The power supply voltage to be used to drive the storage device 203 may be a voltage provided directly from the first power supply voltage VDD or may be a voltage that is generated from the first power supply voltage VDD and lower than the first power supply voltage VDD.

The data terminal SDA is used to transmit and receive a data signal between the controller 350 and the storage device 203. The reset terminal RST is used to supply a reset signal from the controller 350 to the storage device 203.

The first and second attachment detection terminals DT1 and DT2 are used to detect whether or not the printing material container (ink cartridge) 100 is properly attached to the cartridge attachment section 1100. A resistor element RD for the detection of the attachment is arranged between the first attachment detection terminal DT1 and the second attachment detection terminal DT2. The attachment detector 330 detects the attachment of the printing material container 100 on the basis of a standard voltage generated from the high voltage (specifically, the output high voltage VHO) supplied from the high voltage power supply 442 and a current flowing in the resistor element RD. Specifically, when the high voltage VHO that is output from the high voltage application controller 320 is applied to the first attachment detection terminal DT1, the voltage is applied to the resistor element RD and a current flows in the resistor element RD. Then, the attachment detector 330 detects the current and thereby detects the attachment. A method for detecting the attachment is described later in detail.

The first and second short circuit detection terminals CO1 and CO2 are electrically connected to each other in the printing material container 100 (specifically, in the circuit board 200), for example. The cartridge ejection detector 340 detects an electrical conduction between the first and second short circuit detection terminals CO1 and CO2 and thereby detects whether or not the first and second short circuit detection terminals CO1 and CO2 electrically contact with terminals of the cartridge attachment section 1100 corresponding to the first and second short circuit detection terminals CO1 and CO2 or whether or not the printing material container 100 has been properly attached to the cartridge attachment section 1100. The printing device 1000 according to the embodiment uses the first and second attachment detection terminals DT1 and DT2 and the attachment detector 330 and can thereby detect the attachment of the printing material container 100. Thus, the cartridge ejection detector 340 may be omitted. When the cartridge ejection detector 340 is omitted, or when the detection of the attachment is performed without the cartridge ejection detector 340, the first and second short circuit detection terminals CO1 and CO2 might not be electrically connected to each other.

A diode D1 is arranged between the first short circuit detection terminal CO1 and a detection node ND, while a diode D2 is arranged between the second short circuit detection terminal CO2 and the detection node ND. When a detection of an ejection of the cartridge is not performed, the first and second short circuit detection terminals CO1 and CO2 may be connected to the detection node ND without the diodes D1 and D2 therebetween.

The short circuit detector 310 detects a short circuit between at least one of the first and second short circuit detection terminals CO1 and CO2 and at least one of the first and second attachment detection terminals DT1 and DT2 by comparing a voltage of the detection node ND and a reference voltage. Specifically, when the voltage of the detection node ND is higher than the reference voltage, the short circuit detector 310 detects the short circuit. When detecting the short circuit, the short circuit detector 310 outputs a short circuit detection signal VSHT to the controller 350.

Upon receiving a control signal VCNT output from the controller 350, the high voltage application controller 320 blocks the supply of the high voltage VHV output from the high voltage power supply 442. Herein, the reference voltage is set to a voltage value that does not cause the storage device 203 (or a circuit such as the cartridge ejection detector 340) to be broken when the short circuit has occurred. Thus, the short circuit detector 310 can detect the short circuit before the voltage of the detection node ND reaches a voltage value that causes a circuit such as the storage device 203 to be broken.

The controller 350 controls writing or reading of data in or from the storage device 203. In addition, the controller 350 performs control that is necessary to detect attachment or ejection of a cartridge, a short circuit, blocking of supply of the high voltage, and the like. The controller 350 can be achieved by the logic circuit that includes a CMOS transistor and the like, for example. Upon receiving the short circuit detection signal VSHT, the controller 350 outputs to the high voltage application controller 320 the control signal VCNT that is used to block the supply of the high voltage VHV.

As illustrated in FIG. 3A, the first short circuit detection terminal CO1 and the first attachment detection terminal DT1 are adjacent to each other, while the second short circuit detection terminal CO2 and the second attachment detection terminal DT2 are adjacent to each other. If conductive ink or the like adheres to the terminals on the circuit board 200, the adjacent two terminals CO1 and DT1 or the adjacent two terminals CO2 and DT2 may be short-circuited to cause current leakage due to the conductive ink or the like. In addition, the first attachment detection terminal DT1 and the power supply terminal VDD may be short-circuited or the second attachment detection terminal DT2 and the data terminal SDA may be short-circuited.

As described above, when the attachment detector 330 detects the attachment, the high voltage VHO is applied to the first attachment detection terminal DT1. Thus, if at least one of the first and second attachment detection terminals DT1 and DT2 and at least one of the first and second short circuit detection terminals CO1 and CO2 are short-circuited to cause current leakage, there is a possibility that a high voltage may be applied to the cartridge ejection detector 340 during the detection of the attachment. If at least one of the first and second attachment detection terminals and one of the power supply terminal VDD and the data terminal SDA are short-circuited, there is a possibility that a high voltage may be applied to the storage device 203.

In the printing device 1000 according to the embodiment, when the short circuit detector 310 has performed detection of a short circuit between terminals and the short circuit is detected, the high voltage application controller 320 can block the supply of the high voltage VHV from the high voltage power supply 442.

Specifically, if the first attachment detection terminal DT1 and the first short circuit detection terminal CO1 are short-circuited as indicated by B1 of FIG. 4, current flows from the first attachment detection terminal DT1 to the first short circuit detection terminal CO1. Then, the forward current flows from the first short circuit detection terminal CO1 to the detection node ND through the diode D1. As a result, a potential of the detection node ND increases. If the second attachment detection terminal DT2 and the second short circuit detection terminal CO2 are short-circuited as indicated by B2 of FIG. 4, current flows from the second attachment detection terminal DT2 to the second short circuit detection terminal CO2. Then, the forward current flows from the second short circuit detection terminal CO2 to the detection node ND through the diode D2. As a result, the potential of the detection node ND increases. The short circuit detector 310 compares the voltage of the detection node ND with the reference voltage and thereby detects the short circuit. In the following description, the short circuit occurred between the first attachment detection terminal DT1 and the first short circuit detection terminal CO1 and the short circuit occurred between the second attachment detection terminal DT2 and the second short circuit detection terminal CO2 are each referred to as a "short circuit" or a "short circuit between terminals".

The resistor element RA is arranged between the high voltage power supply 442 and the first attachment detection terminal DT1. Specifically, the resistor element RA is arranged between the high voltage power supply 442 and the integrated circuit device 300. The electrostatic capacitor element (capacitor) CA is arranged between the detection node ND of the short circuit detector 310 and a low-potential-side power supply node (ground node) VSS. With such a configuration, when the short circuit is detected, a period from the time when the high voltage (output high voltage VHO) is applied to the first attachment detection terminal DT1 to the time when the voltage of the detection node ND reaches a predetermined voltage is set on the basis of a resistance of the resistor element RA and a capacitance of the electrostatic capacitor element CA. The predetermined voltage is higher than the aforementioned reference voltage and does not cause the storage device 203 or the like to be broken.

Since the resistor element RA and the electrostatic capacitor element CA are arranged, the potential of the detection node ND is allowed to gradually increase. Specifically, the larger the product of the resistance of the resistor element RA and the capacitance of the electrostatic capacitor element CA, the longer the period from the time when the high voltage (output high voltage VHO) is applied to the first attachment detection terminal DT1 to the time when the voltage (voltage set using the voltage VSS as a standard voltage) of the detection node ND reaches the predetermined voltage. By allowing the voltage of the detection node ND to gradually increase, the supply of the high voltage VHV can be blocked before the voltage to be applied to a terminal reaches a voltage that causes a circuit such as the storage device 203 to be broken, as described later.

In the printing device 1000 according to the embodiment, when the short circuit detector 310 has performed detection of a short circuit between terminals and the short circuit is detected, the high voltage application controller 320 blocks the supply of the high voltage VHV from the high voltage power supply 442. In addition, since the resistor element RA and the electrostatic capacitor element CA are arranged, the voltage of the detection node ND is allowed to gradually increase. Thus, the supply of the high voltage VHV can be blocked before a high voltage that causes a circuit such as the storage device 203 to be broken is applied. As a result, the printing device that can reliably and safely detect the attachment of the printing material container and is highly reliable can be achieved.

Since the resistor element RA is arranged between the high voltage power supply 442 and the integrated circuit device 300, the resistor element RA can function as an overcurrent protective resistor element for the high voltage power supply 442. In addition, the resistor element RA can function as a short circuit detection resistor element that is used to detect a short circuit between a high voltage power supply node included in the integrated circuit device 300 and the low-potential-side power supply node. When the short circuit has occurred between the high voltage power supply node and the low-potential-side power supply node in the integrated circuit device 300 for some reason, the amount of a current that flows in the resistor element RA rapidly increases. Thus, the high voltage VHV that is input to the integrated circuit device 300 rapidly drops. The short circuit occurred in the integrated circuit device 300 can be detected by detecting the voltage drop. A circuit for detecting the voltage drop (not illustrated) may include a comparator.

Figure 5:
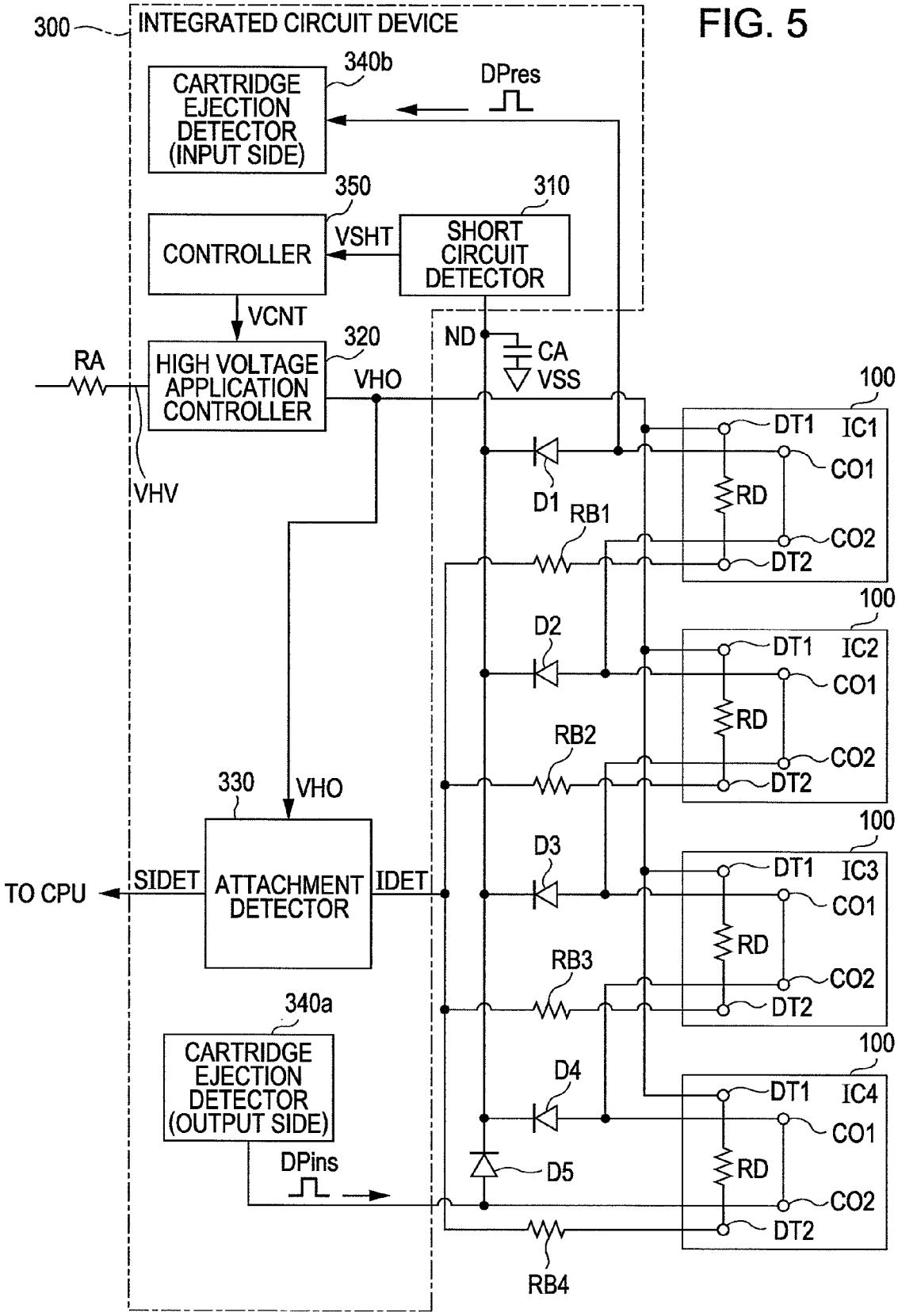
FIG. 5 is a diagram illustrating an example of a configuration in which a plurality of printing material containers are included in the printing device.

FIG. 5 illustrates an example in which a plurality of printing material containers are included in the printing device 1000 according to the embodiment. In the example of the configuration illustrated in FIG. 5, the printing device 1000 includes four printing material containers (ink cartridges) 100 (IC1 to IC4). The number of printing material containers is not limited to four and may be two, three, five or more.

The printing material containers IC1 to IC4 each have the same configuration as the configuration illustrated in FIG. 4, and a detailed description thereof is omitted. The integrated circuit device 300 illustrated in FIG. 5 has the same configuration as the configuration illustrated in FIG. 4. In FIG. 5, however, the cartridge ejection detector 340 is divided into a cartridge ejection detector (output side) 340*a* and a cartridge ejection detector (input side) 340*b* for convenience of the illustration.

When the printing device 1000 includes the plurality of printing material containers, the first and second short circuit detection terminals CO1 and CO2 of the printing material containers (for example, IC1 to IC4) are connected to the detection node ND of the single short circuit detector 310 through a plurality of diodes (for example, D1 to D5). Specifically, the first short circuit detection terminal CO1 of the printing material container IC1 is connected to the detection node ND through the diode D1. The second short circuit detection terminal CO2 of the printing material container IC1 and the first short circuit detection terminal CO1 of the printing material container IC2 are connected to the detection node ND through the diode D2. The second short circuit detection terminal CO2 of the printing material container IC2 and the first short circuit detection terminal CO1 of the printing material container IC3 are connected to the detection node ND through the diode D3. Cathodes (negative electrodes) of the diodes are connected to the detection node ND. In this configuration, the short circuit detector 310 can detect a short circuit without affecting detection of ejections of the cartridges by the cartridge ejection detector 340.

A method for detecting the short circuit is similar to the method described with reference to FIG. 4. The short circuit detector 310 compares the voltage of the detection node ND with the reference voltage and thereby detects the short circuit. Specifically, when the voltage of the detection node ND is higher than the reference voltage, the short circuit detector 310 detects the short circuit. When the short circuit detector 310 has detected the short circuit, the high voltage application controller 320 blocks the supply of the high voltage VHV from the high voltage power supply 442.

Resistor elements RB1 to RB4 are used to detect attachment of the printing material containers IC1 to IC4 by the attachment detector 330 and have resistances that are different from each other. Thus, the attachment detector 330 can detect a printing material container among the printing material containers IC1 to IC4 that is not attached to the cartridge attachment section 1100. A method for detecting the attachment is described later in detail.

The cartridge ejection detector 340 (340*a*, 340*b*) detects ejections of the printing material containers (ink cartridges) in the following manner. When all the four printing material containers IC1 to IC4 are attached, the first and second short circuit detection terminals CO1 and CO2 of the printing material containers IC1 to IC4 are electrically connected to each other, as illustrated in FIG. 5. Thus, a signal DPins that is output from the cartridge ejection detector (output side) 340*a* is detected as a signal DPres by the cartridge ejection detector (input side) 340*b*. When any of the four ink cartridges IC1 to IC4 is not attached, the first and second short circuit detection terminals CO1 and CO2 of the printing material containers IC1 to IC4 are not completely electrically connected to each other. In this case, the cartridge ejection detector (input side) 340*b* does not detect the signal DPres. In this manner, the cartridge ejection detector 340 can detect, on the basis of whether or not the cartridge ejection detector (input side) 340*b* detects the signal DPres, whether or not an ink cartridge among the ink cartridges has been ejected.

2. Example of Detailed Configurations of Circuits

Figure 6:
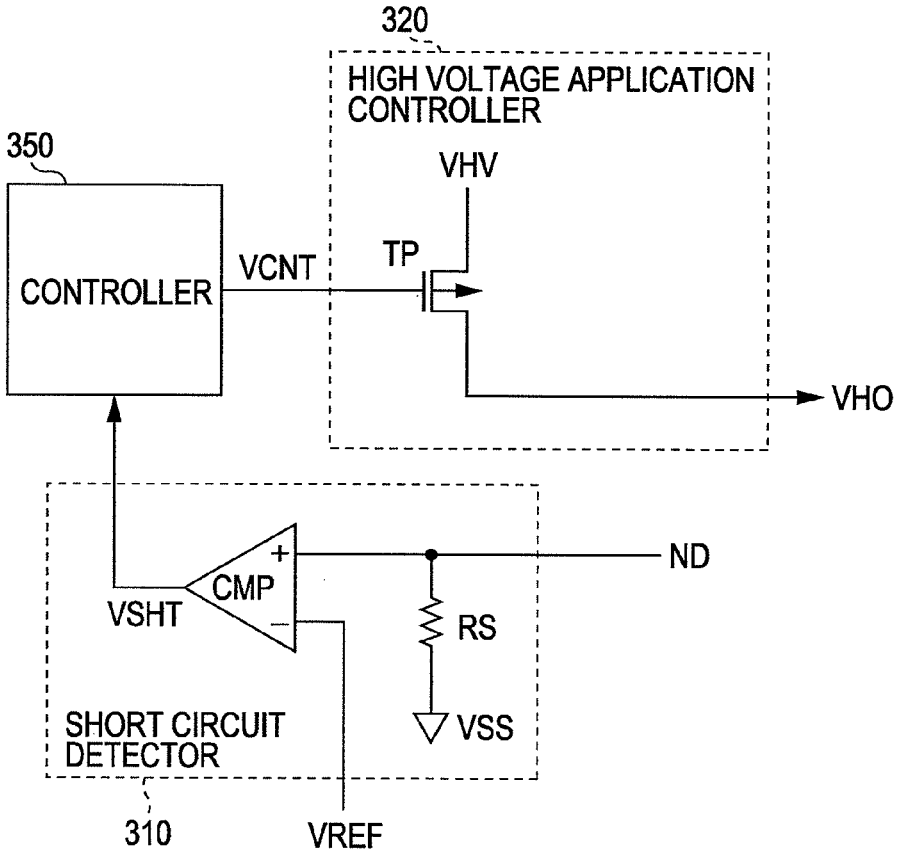
FIG. 6 is a diagram illustrating an example of a detailed configuration of a short circuit detector and a detailed configuration of a high voltage application controller.

FIG. 6 illustrates an example of a detailed configuration of the short circuit detector 310 and a detailed configuration of the high voltage application controller 320. The short circuit detector 310 includes a comparator CMP and a resistor element RS. The high voltage application controller 320 includes a P-type transistor TP. The short circuit detector 310 and the high voltage application controller 320 that are used in the embodiment are not limited to those having the configurations illustrated in FIG. 6. The short circuit detector 310 and the high voltage application controller 320 may be variously modified. Some of the constituent elements of the short circuit detector 310 and high voltage application controller 320 may be omitted or replaced with other constituent elements. Other constituent elements may be added to the short circuit detector 310 and the high voltage application controller 320.

As described above, when a short circuit has occurred, a voltage that is higher than the ground voltage (low-potential-side power supply voltage) VSS (for example, 0 V) is applied to the detection node ND during the detection of the attachment of a printing material container. The voltage of the detection node ND is applied to an input terminal (+) of the comparator CMP. A reference voltage VREF is applied to an input terminal (−) of the comparator CMP.

When the voltage of the input terminal (+) is lower than the reference voltage VREF, the comparator CMP outputs a low (L) level signal as the short circuit detection signal VSHT. When voltage of the input terminal (+) is higher than the reference voltage VREF, the comparator CMP outputs a high (H) level signal as the short circuit detection signal VSHT. When a short circuit has occurred, the voltage of the detection node ND is higher than the reference voltage VREF and the short circuit detection signal VSHT is set to the H level signal. The reference voltage VREF is set to a voltage value that does not Cause the storage device 203 or the like to be broken when the short circuit has occurred.

When the short circuit detector 310 detects a short circuit or when the level of the short circuit detection signal VSHT is changed from the L level to the H level, the controller 350 changes the control signal VCNT from a low (L) level to a high (H) level.

A source of the P-type transistor TP is connected to a high voltage power supply node VHV. The control signal VCNT is input to a gate of the P-type transistor TP from the controller 350. When the level of the control signal VCNT is the L level, the P-type transistor TP is in the ON state and the high voltage VHO is output from a drain of the P-type transistor TP. On the other hand, when the level of the control signal VCNT is the H level, or when a short circuit has been detected, the P-type transistor TP is turned off so that the supply of the high voltage is blocked. When the short circuit detector 310 has detected a short circuit, the control signal VCNT to be output from the controller 350 is set to the H level and the P-type transistor TP is turned off. As a result, the high voltage VHO is blocked.

When the high voltage VHO is blocked, the high voltage is not applied to the first attachment detection terminal DT1 of the printing material container 100. Thus, the voltage of the detection node ND decreases to a low (L) level. In this case, the short circuit detection signal VSHT is changed to the L level again. The controller 350, however, continues to maintain the control signal VCNT at the H level. Thus, when a short circuit has occurred between terminals, the short circuit detector 310 can detect the short circuit and the high voltage application controller 320 can block the supply of the high voltage.

Figure 7:
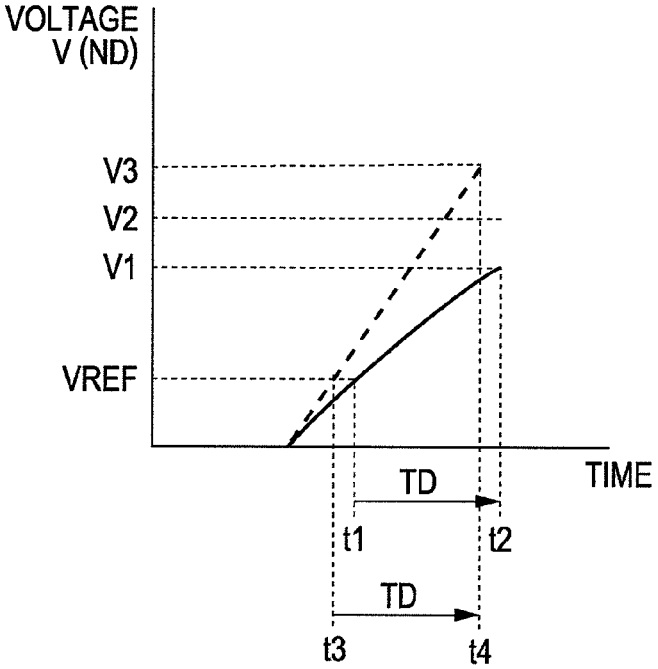
FIG. 7 is a diagram describing effects of a resistor element and an electrostatic capacitor element.

FIG. 7 is a diagram describing effects of the resistor element RA and the electrostatic capacitor element CA. FIG. 7 illustrates a change in the voltage V (ND) of the detection node ND with time in the case where a short circuit has occurred during the detection of the attachment of a printing material container. A solid line indicates the case in which the product (time constant) of the resistance of the resistor element RA and the capacitance of the electrostatic capacitor element CA is large, while a broken line indicates the case in which the product is small.

When the high voltage VHO is applied, the voltage V (ND) of the detection node. ND increases as illustrated in FIG. 7. The larger the time constant, the more gradual the increase in the voltage. The smaller the time constant, the steeper the increase in the voltage. When the voltage V (ND) exceeds the reference voltage VREF, the short circuit detector 310 detects a short circuit. In the case illustrated in FIG. 7, when the time constant is large (solid line), the short circuit detector 310 detects the short circuit at a time t1. When the time constant is small (broken line), the short circuit detector 310 detects the short circuit at a time t3.

A period (delay time) from the time when the short circuit detector 310 detects the short circuit to the time when the high voltage application controller 320 blocks the high voltage VHO is indicated by TD in FIG. 7. As illustrated in FIG. 7, when the time constant is large (solid line), the high voltage VHO is blocked at a time t2 and the voltage V (ND) increases and reaches a voltage value V1 at the time t2. When the time constant is small (broken line), the high voltage VHO is blocked at a time t4 and the voltage V (ND) increases and reaches a voltage value V3 (V3>V1) at the time t4. When the time constant is set to a large value, the voltage V (ND) when the high voltage VHO is blocked can be set to a low value.

As illustrated in FIG. 7, when the voltage V (ND) exceeds a voltage value V2 and there is a possibility that the storage device 203 or the like is broken, the time constant is adjusted so that the voltage V (ND) when the high voltage VHO is blocked can be set to a voltage value lower than the voltage value V2. The resistance of the resistor element RA and the capacitance of the electrostatic capacitor element CA can be set to desired values by a circuit simulation or the like in the range that the desired values do not affect the detection of the attachment of a printing material container.

Figure 8A:
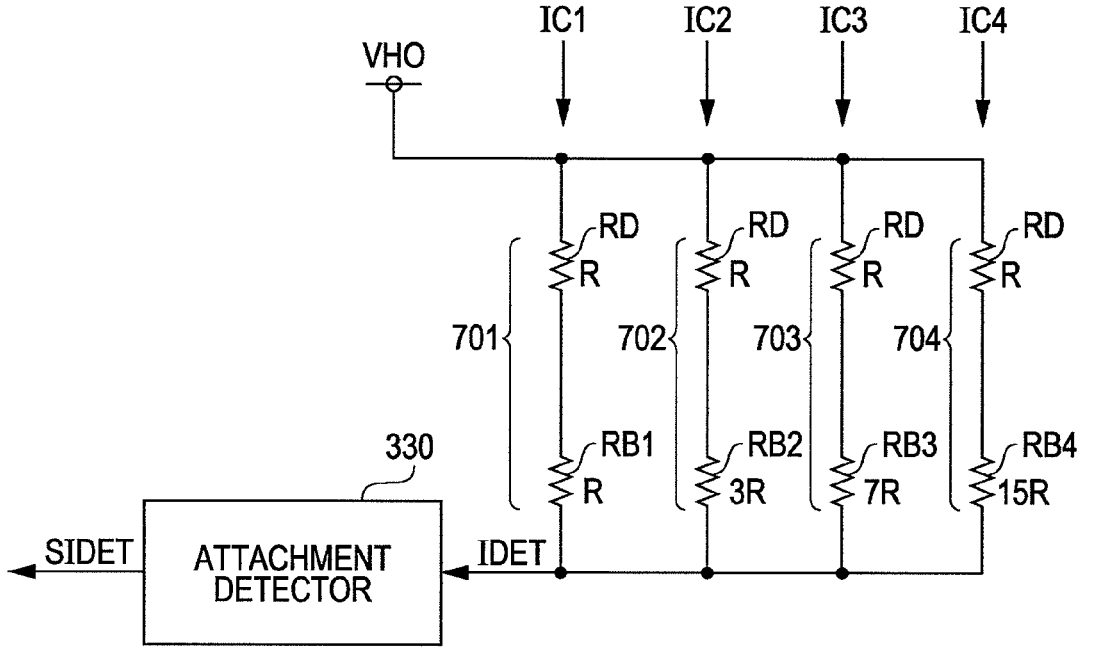
FIGS. 8A and 8B are diagrams describing a method for detecting attachment of cartridges.
Figure 8B:
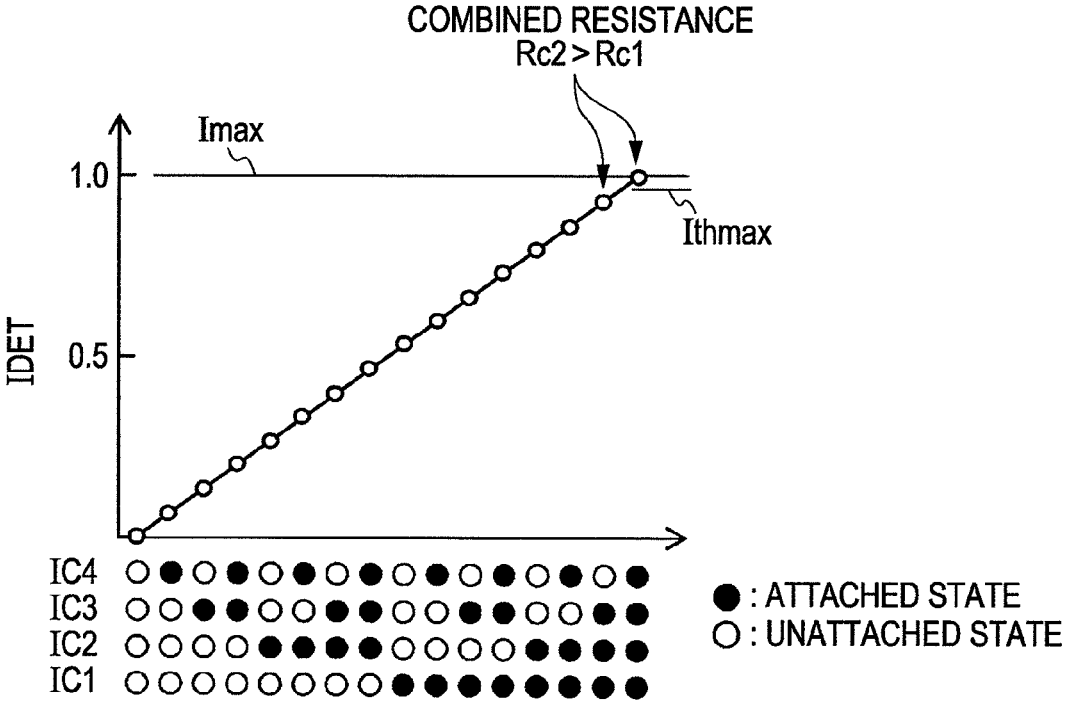

FIGS. 8A and 8B are diagrams describing a method for detecting attachment of cartridges (printing material containers) to a printing device according to the invention. FIG. 8A illustrates the state in which all the cartridges IC1 to IC4 are attached to the cartridge attachment section 1100 of the printing device 1000. Resistances of resistor elements RD for detection of attachment of the four cartridges IC1 to IC4 are set to the same value R. Resistor elements RB1 to RB4 are connected in series to the resistor elements RD of the cartridges IC1 to IC4, respectively. Resistances of the resistor elements RB1 to RB4 are set to different values. Specifically, a resistance of a resistor element RBn that is among the resistor elements RB1 to RB4 and corresponds to an nth (n is in a range of 1 to 4) cartridge ICn is set to a value of $(2^n-1)R$ (R is a constant value). As a result, a serial connection of the resistor element RD for the detection of the attachment of the nth cartridge ICn to the resistor element RBn forms a resistor with a resistance of $2^nR$. A resistor that has a resistance of $2^nR$ and corresponds to the nth (n is in a range of 1 to N) cartridge is connected in parallel to the attachment detector 330. Combined resistors 701 to 704 that are formed by serial connections of the resistor elements RD for the detection of attachment to the resistor elements RB1 to RB4 are also referred to as "resistors".

When a bias voltage that is applied to the attachment detector 330 is indicated by VREF, the value of a current IDET that is detected by the attachment detector 330 is a value ((VHO−VREF)/Rc) obtained by dividing a voltage of (VHO−VREF) by a combined resistance Rc of the four resistors 701 to 704. When the number of cartridges is N, and all the N cartridges are attached, the detected current IDET is represented by the following Equations (1) and (2).

$$I_{DET} = \frac{VHO - VREF}{R_c} \quad (1)$$

-continued $$R_c = R\frac{1}{\sum_{j=1}^{N}\frac{1}{2^j}} \quad (2)$$

When one or more cartridges are not attached, the combined resistance Rc increases and the detected current IDET is reduced in accordance with the number of the cartridges that are not attached.

FIG. 8B illustrates relationships between the detected current IDET and attached or unattached states of the cartridges IC1 to IC4. In FIG. 8B, the abscissa indicates sixteen patterns of attached or unattached states of the cartridges IC1 to IC4, while the ordinate indicates a value of the detected current IDET for each of the patterns of the states of the cartridges IC1 to IC4. The sixteen patterns of the states of the cartridges IC1 to IC4 correspond to sixteen combinations obtained by selecting one to four cartridges from among the four cartridges IC1 to IC4. Each of the combinations is also referred to as a "subset". The values of the detected current IDET uniquely identify the sixteen patterns of the states of the cartridges IC1 to IC4. In other words, the resistances of the four resistors 701 to 704 corresponding to the four cartridges IC1 to IC4 are set so that the sixteen patterns of the states of the four cartridges IC1 to IC4 lead to different combined resistances Rc.

When all the four cartridges IC1 to IC4 are in the attached states, the detected current IDET has the maximum value Imax among the values of the detected current IDET. On the other hand, when only the cartridge IC4 that corresponds to the resistor 704 with the largest resistance is unattached, the value of the detected current IDET is 0.93 times the maximum value Imax. Thus, by detecting whether or not the value of the detected current IDET is equal to or higher than a threshold Ithmax that is between the aforementioned two current values, it is possible to detect whether or not all the four cartridges IC1 to IC4 have been attached. Note that the voltage VHO that is higher than a power supply voltage of approximately 3.3 V of the normal logic circuit is used so as to increase a dynamic range of the detected current IDET and thereby improve the accuracy of detection of the attachment.

The attachment detector 330 converts the detected current IDET into a digital detection signal SIDET and transmits the digital detection signal SIDET to the CPU 410 (illustrated in FIG. 4). The CPU 410 can determine the current attachment state from among the sixteen patterns of the states of the cartridges on the basis of a value of the digital detection signal SIDET. When the CPU 410 determines that one or more cartridges are not attached, the CPU 410 causes the display unit 430 to display information (characters and/or an image) of the unattached state and informs the user of the unattached state.

In the process of detecting the attachment of the cartridges, the combined resistance Rc is uniquely determined corresponding to the state among $2^N$ patterns of attached or unattached states of the N cartridges and the detected current IDET is uniquely determined in accordance with the combined resistance Rc. It is assumed that acceptable errors of the combined resistance of the resistors 701 to 704 are ±ϵ. It is assumed that a first combined resistance of the cartridges IC1 to IC4 when all the cartridges IC1 to IC4 are attached is Rc1 and a second combined resistance of the cartridges IC1 to IC3 when only the cartridge IC4 is unattached is Rc2. Based on this assumption, a relationship of Rc1<Rc2 is established (refer to FIG. 8B). It is preferable that the relationship of Rc1<Rc2 be satisfied when the combined resistance of the resistors 701 to 704 varies in the acceptable error range of ±ϵ. In the worst-case condition, the first combined resistance Rc1 is the maximum value Rc1max in the range of the first combined resistance Rc1 and the second combined resistance Rc2 is the minimum value Rc2min in the range of the second combined resistance Rc2 in consideration of the acceptable errors ±ϵ. In order to identify the combined resistances Rc1max and Rc2min, it is sufficient if the relationship of Rc1max<Rc2min is satisfied. The following Formula (3) is derived from the relationship of Rc1max<Rc2min.

$$\varepsilon < \frac{1}{4(2^{N-1}-1)} \quad (3)$$

When the acceptable errors ±ϵ satisfy Formula (3), it is ensured that the combined resistance Rc is uniquely determined in accordance with the attached or unattached states of the N cartridges and the detected current IDET is uniquely determined corresponding to the combined resistance Rc. It is, however, preferable that the acceptable error ϵ of the actually designed combined resistance be smaller than the value of the right-hand side of Formula (3). In addition, the acceptable error ϵ of the combined resistance of the resistors 701 to 704 may be set to a sufficiently small value, for example, a value of 1% or smaller without the aforementioned consideration.

Figure 9:
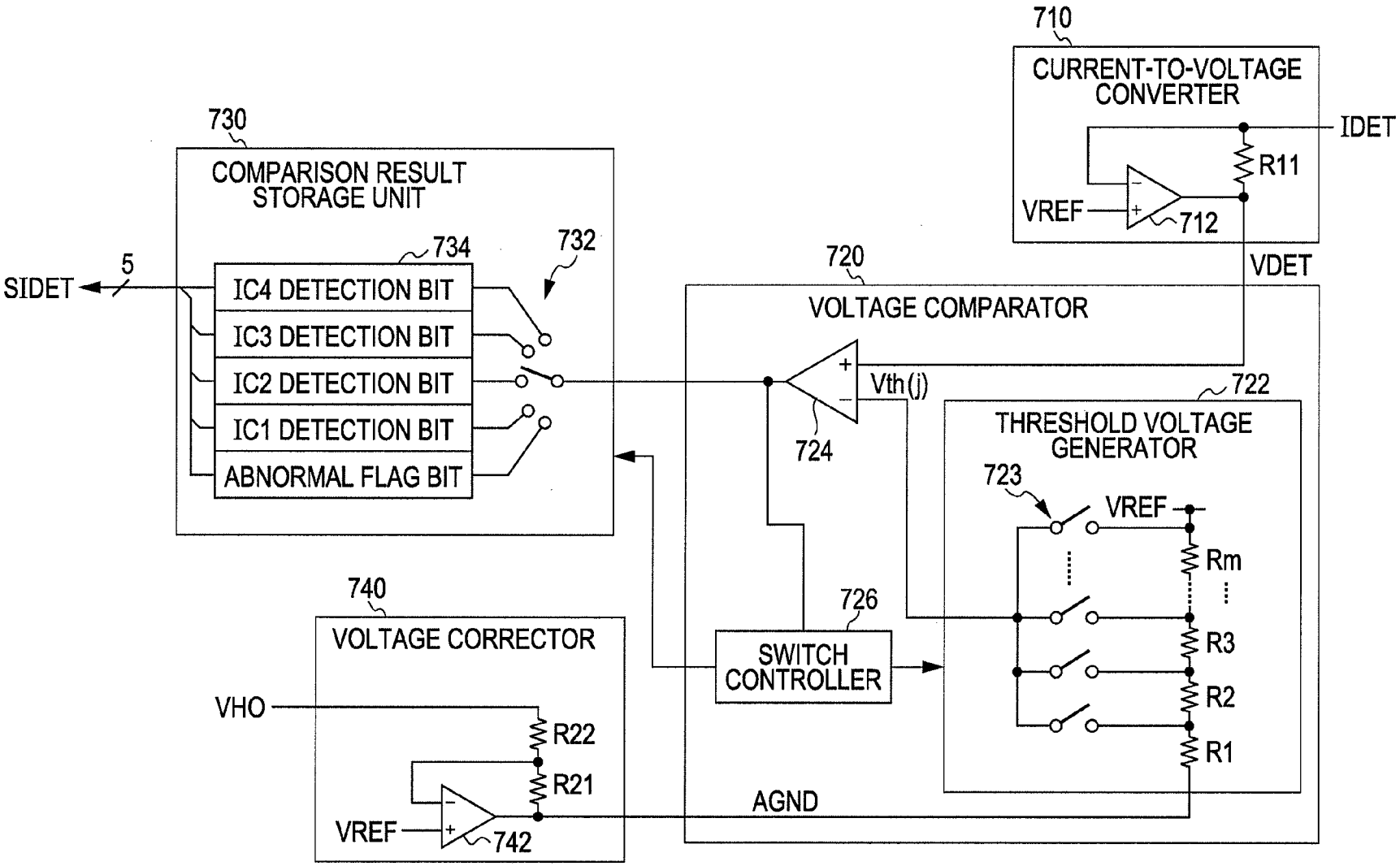
FIG. 9 is a diagram illustrating an example of a detailed configuration of an attachment detector.

FIG. 9 illustrates an example of a detailed configuration of the attachment detector 330 of the printing device 1000 according to the embodiment. The attachment detector 330 includes a current-to-voltage converter 710, a voltage comparator 720, a comparison result storage unit 730 and a voltage corrector 740. The configuration of the attachment detector 330 according to the embodiment is not limited to the configuration illustrated in FIG. 9 and may be variously modified. Some of the constituent elements of the attachment detector 330 may be omitted or replaced with other constituent elements. Other constituent elements may be added to the attachment detector 330.

The current-to-voltage converter 710 is an inverting amplifier circuit that includes an operational amplifier 712 and a feedback resistor R11. A voltage VDET that is output from the operational amplifier 712 is represented by the following Equation (4).

$$\begin{aligned} V_{DET} &= VREF - I_{DET}\cdot R11 \\ &= VREF - (VHO - VREF)\frac{R11}{R_c} \end{aligned} \quad (4)$$

In Equation (4), VHO is the voltage output from the high voltage application controller 320 (illustrated in FIG. 4), and RC is the combined resistance of the four resistors 701 to 704 (illustrated in FIG. 8A). The value of the voltage VDET corresponds to the detected current IDET.

The voltage VDET that is represented by Equation (4) is a voltage obtained by inverting a voltage (IDET R11) determined by the detected current IDET. An inverting amplifier may be added to the current-to-voltage converter 710 so that the current-to-voltage converter 710 outputs a voltage that is obtained by inverting the voltage VDET by the added inverting amplifier. It is preferable that an absolute value of an amplification factor of the added inverting amplifier be 1.

The voltage comparator 720 has a threshold voltage generator 722, a comparator (operational amplifier) 724 and a switch controller 726. The threshold voltage generator 722 uses a switch 723 to select one of a plurality of threshold voltages Vth(j) obtained by dividing the reference voltage VREF by a plurality of resistors R1 to Rm and outputs the selected threshold voltage. The plurality of threshold voltages Vth(j) correspond to thresholds that identify values, corresponding to the sixteen patterns of the attached or unattached states of the cartridges, of the detected current IDET. The comparator 724 compares the voltage VDET output from the current-to-voltage converter 710 with the threshold voltage Vth(j) output from the threshold voltage generator 722 and outputs a binary result of the comparison.

The switch controller 726 controls, on the basis of the result of the comparison of the output voltage VDET with the threshold voltage Vth(j), switching of a threshold voltage Vth(j) that will be subsequently output from the threshold voltage generator 722.

The comparison result storage unit 730 sets a flag (for example, writes 1) in an appropriate bit position included in a bit register 734 on the basis of the binary comparison result output from the voltage comparator 720. The switch controller 726 specifies a time for the switching that is performed by a switch 732. The bit resister 734 includes N (N=4 in this example) cartridge detection bits and an abnormal flag bit. The cartridge detection bits indicate whether or not the cartridges that can be attached to the printing device are in the attached states. The abnormal flag bit indicates that an abnormal current value has been detected. The abnormal flag bit is set to a high (H) level when a significantly large amount of current flows, compared with the value Imax (illustrated in FIG. 8B) of the current flowing when all the cartridges are in the attached states. The abnormal flag bit, however, may be omitted. The attachment detector 330 transmits the plurality of bits stored in the bit resister 734 as the digital detected signal SIDET (detected current signal) to the CPU 410 (illustrated in FIG. 4) of the main controller 400. The CPU 410 determines, on the basis of the bit values of the digital detected signal SIDET, whether or not the cartridges have been attached. As described above, the four bit values of the digital detected signal SIDET indicate whether or not the cartridges have been attached. Thus, the CPU 410 can immediately determine, on the basis of the bit values of the digital detected signal SIDET, whether or not the cartridges have been attached.

The voltage comparator 720 and the comparison result storage unit 730 form an analog-to-digital (AD) converter. Known other configurations can be used as the analog-to-digital converter, instead of the voltage comparator 720 and the comparison result storage unit 730 (illustrated in FIG. 9).

The voltage corrector 740 is a circuit that corrects, in response to a variation in the high voltage VHO for the detection of attachment, the plurality of threshold voltages Vth(j) generated by the threshold voltage generator 722. The voltage corrector 740 is an inverting amplifier circuit that includes an operational amplifier 742 and two resistors R21 and R22. The voltage VHO that is output from the high voltage application controller 320 is input to an inverting input terminal of the operational amplifier 742 through the resistor R22. The reference voltage VREF is input to a non-inverting input terminal of the operational amplifier 742. A voltage AGND that is output from the operational amplifier 742 is represented by the following Equation (5).

$$AGND = VREF - (VHO - VREF)\frac{R21}{R22} \tag{5}$$

The voltage AGND is used as a standard voltage AGND to be applied to a low-voltage-side part of the threshold voltage generator 722. For example, when the voltage VREF is 2.4 V, the voltage VHO is 42 V, the resistor R21 has a resistance of 20 kΩ and the resistor R22 has a resistance of 400 kΩ, the voltage AGND is 0.42 V. As can be understood from the comparison of Equation (4) with Equation (5), the standard voltage AGND that is applied to the low-voltage-side part of the threshold voltage generator 722 varies in accordance with the voltage VHO (or the high voltage power supply VHV) output from the high voltage application controller 320 in a similar manner to the detected voltage VDET. The difference between the two voltages AGND and VDET results from the difference between the resistance ratio of R21/R22 and the resistance ratio of R11/Rc. When the voltage corrector 740 is used and the power supply voltage VHV varies for some reason, the threshold voltages Vth(j) that are generated by the threshold voltage generator 722 vary in accordance with the variation in the power supply voltage VHV. As a result, the detected voltage VDET and the threshold voltages Vth(j) vary in accordance with the variation in the power supply voltage VHV. Thus, the voltage comparator 720 can output an accurate comparison result that indicates the attached or unattached states of the cartridges. When the resistance ratio of R21/R22 and the resistance ratio of R11/Rc1 (Rc1 is the combined resistance when all the cartridges are in the attached states) are set to be equal to each other, the detected voltage VDET and the threshold voltages Vth(j) can vary in accordance with the variation in the power supply voltage VHV so that a change in the detected voltage VDET and changes in the threshold voltages Vth(j) are nearly equal to each other. The voltage corrector 740 may be omitted.

As described above, when a plurality of printing material containers (ink cartridges) are used in a printing device according to the embodiment, the printing device can detect that an ink cartridge is not attached to the printing device. If a short circuit has occurred between terminals of an ink cartridge during detection of the attachment, the printing device can detect the short circuit and block the supply of a high voltage to be used for the detection of the attachment. In addition, since a resistor element and an electrostatic capacitor element are arranged, the printing device can suppress a steep increase in the voltage to be applied to the terminals. As a result, the printing device can block the supply of the high voltage before the voltage that is applied to the terminals reaches a voltage value that may cause a circuit such as a storage device to be broken. Thus, the printing device that can reliably and safely detect the attachment of printing material containers and is highly reliable can be achieved.

The embodiment is described above in detail. It will be understood by those skilled in the art that various changes and modifications can be made herein without materially departing from the new matters and effects of the invention. Thus, such changes and modifications are all included in the scope of the invention. For example, terms that are described together with broader or synonymous different terms at least once in this specification or the drawings can be replaced with those different terms in any section of the specification and the drawings. The configuration and operations of the printing device are not limited to those described in the embodiment, and can be variously modified.

The entire disclosure of Japanese Patent Application No. 2011-120284, filed on May 30, 2011 is expressly incorporated herein by reference.

What is claimed is:

1. A printing device comprising:

a printing material container that includes a first short circuit detection terminal, a second short circuit detection terminal, a first attachment detection terminal and a second attachment detection terminal;

a high voltage power supply that applies a high voltage to the first attachment detection terminal;

a short circuit detector that detects a short circuit between at least one of the first and second short circuit detection terminals and at least one of the first and second attachment detection terminals on the basis of a comparison between a voltage of a detection node and a reference voltage;

a high voltage application controller that blocks supply of the high voltage from the high voltage power supply when the short circuit detector detects the short circuit;

a resistor element that is arranged between the high voltage power supply and the first attachment detection terminal; and an electrostatic capacitor element that is arranged between the detection node of the short circuit detector and a low-potential-side power supply node, wherein when the short circuit detector detects the short circuit, a period from the time when the high voltage is applied to the first attachment detection terminal to the time when the voltage of the detection node reaches a predetermined voltage is set on the basis of a resistance of the resistor element and a capacitance of the electrostatic capacitor element.

2. The printing device according to claim 1, further comprising an integrated circuit device, wherein the short circuit detector and the high voltage application controller are arranged in the integrated circuit device, and wherein the resistor element is arranged between the high voltage power supply and the integrated circuit device and is an overcurrent protective resistor element for the high voltage power supply.

3. The printing device according to claim 2, wherein the resistor element is a short circuit detection resistor element that is used to detect a short circuit between a high voltage power supply node included in the integrated circuit device and the low-potential-side power supply node.

4. The printing device according to claim 2, wherein the printing material container includes an attachment detection resistor element that is arranged between the first attachment detection terminal and the second attachment detection terminal, and wherein the integrated circuit device includes an attachment detector that detects an attachment of the printing material container on the basis of a current flowing in the attachment detection resistor element and a standard voltage generated from the high voltage supplied from the high voltage power supply.

5. The printing device according to claim 1, wherein a plurality of printing material containers are included, and wherein the first and second short circuit detection terminals of the printing material containers are connected to the detection node of the single short circuit detector through a plurality of diodes.

6. The printing device according to claim 1, wherein the printing material container includes a storage device, and wherein the reference voltage is set to a voltage value that does not cause the storage device to be broken when the short circuit detector detects the short circuit.

* * * * *